United States Patent [19]

Stevens

[11] 4,074,763

[45] Feb. 21, 1978

[54] BOTTOM-HOLE GAS-LIQUID SEPARATOR

[75] Inventor: Robert A. Stevens, Calgary, Canada

[73] Assignee: Chevron Research Company, San Francisco, Calif.

[21] Appl. No.: 751,790

[22] Filed: Dec. 17, 1976

[51] Int. Cl.[2] ..... E21B 43/02

[52] U.S. Cl. ..... 166/325; 55/459 A; 166/105.5

[58] Field of Search ..... 166/105.5, 105.6, 325, 166/265; 55/459 R, 459 A

[56] References Cited

U.S. PATENT DOCUMENTS

| | | | |
|---|---|---|---|
| 2,872,985 | 2/1959 | Bertuzzi et al. | 166/105.5 |
| 3,048,122 | 8/1962 | Hansen | 166/105.5 |
| 3,128,719 | 4/1964 | Jongbloed et al. | 166/105.5 |

FOREIGN PATENT DOCUMENTS

| | | | |
|---|---|---|---|
| 1,325,556 | 6/1962 | France | 55/459 A |

*Primary Examiner*—Ernest R. Purser
*Assistant Examiner*—William F. Pate, III
*Attorney, Agent, or Firm*—R. L. Freeland, Jr.; Edward J. Keeling

[57] ABSTRACT

The invention relates to gas-liquid separator useful in a well and utilizes centrifugal force to assist in separating gas from liquid and includes a central inner tubular member for flowing gas thus separated through the incoming gas-liquid mixture and also an annular passage for gas flow up through the incoming gas-liquid mixture.

3 Claims, 5 Drawing Figures

BOTTOM-HOLE GAS-LIQUID SEPARATOR

BACKGROUND OF THE INVENTION

The present invention relates to separation of fluid mixtures of different densities, and particularly the present invention relates to a liquid and gas separator adapted to be incorporated in the production tubing of a liquid well. In liquid-producing wells and particularly in deep producing wells where liquid is pumped to the surface, a problem is often encountered handling the gas commonly associated with the liquid in the producing formation. There is usually a substantial decrease in pressure on the liquid-gas mixture as it moves out of the liquid-bearing formation into the production well. Hydrocarbon gas, either in solution with the liquid or in the free state, expands as the gas-liquid mixture enters the production borehole. If the gas is pumped with the liquid to the surface serious difficulty is likely to be encountered with the pumping apparatus. A positive displacement pump will act as a compressor of the gas and will lose much of its efficiency in lifting liquid to the surface. In severe cases, the pump may become "gas locked" as a result pumping gas and damage to the pump may result.

Gas and liquid separators have been utilized in order to remedy this problem. Generally, the gas and liquid separator is a device which, by utilizing the different properties of the two substances, affects the separation of the liquid which is usually a mixture of oil and water and the gas and allows them to be moved to the surface through different conduits. It is in this general area that the present invention finds its utility. It should be noted, however, that the apparatus herein described is useful not only to separate well liquids and gas, but may also be used in separating any two fluid substances which have different specific gravities. An example of situations other than gas and well liquid separators where the apparatus may be used effectively include separating a gas and water mixture. Therefore, the apparatus, although described herein as primarily useful as a gas and well fluids separator, may be used to perform similar operations with no substantial alteration of the apparatus itself.

A device for separating liquid and gas is shown in U.S. Pat. No. 2,652,130, issued Sept. 15, 1953 to Cedric K. Ferguson. The device of the patent uses centrifugal force to assist in separating the gas from the liquid and provides an arrangement of conduits for transmitting the gas and liquid to the surface. There is still need, however, for a gas-liquid separator which utilizes centrifugal force in assisting the separation of the liquid and gas and provides a more direct and easy passage of the liquid and gas to the surface thus resulting in less pressure drop in the separator and also simpler construction.

SUMMARY OF THE PRESENT INVENTION

The present invention provides a bottom-hole, gas-liquid separator which includes an elongated outer tubular member having an outer diameter suitable for running in a well to a position for producing fluids therefrom. The lower end of the outer tubular member is provided with removable plug means to close it off to fluid flow. An outlet for gas is formed in a wall of the outer tubular member near the upper portion thereof. The outer tubular member is provided with coupling means for connecting it to the lower end of a production string below a downhole pump for producing liquid from the well. An outer inlet for fluid is formed in the wall of the outer tubular member intermediate the ends thereof and substantially below the outlet for gas. An intermediate tubular member, smaller than the outer tubular member, is connected interiorly of the outer tubular member in concentric relationship therewith. The intermediate tubular member extends at least three times its outer diameter above the outer fluid inlet and at least six times its outer diameter below the outer fluid inlet. The intermediate tubular member forms an outer annular chamber with the outer tubular member. An inner inlet for fluid is formed in the wall of the intermediate tubular member below the outer inlet for fluid. An inner tubular member is arranged concentrically inside of the intermediate tubular member and forms an inner annular chamber with the intermediate tubular member adjacent the outer inlet and the inner inlet. The inner tubular member extends from just above the inner inlet to no more than 20 diameters below the inner inlet. Conduit means are provided to connect the outer inlet with the inner inlet and provide the only flow path for fluid from the outer inlet through the outer annular chamber into the intermediate tubular member through the inner inlet. The conduit means are arranged to divert the flow of fluids downwardly and tangentially into the inner annular chamber. A baffle plate is connected in the lower end of the intermediate tubular member to stop the votex flow of fluids to prevent gas from being drawn down with the liquid. Gas conduit means spaced above and apart from the top of the inner tubular member are provided to connect the upper end of the intermediate tubular member to the outlet for gas.

OBJECTS OF THE INVENTION

It is a principal object of the present invention to provide a downhole gas-liquid separator for use in a well which incorporates centrifugal force to assist in separating gas and liquid and which has a central inner tubular member to provide an uninterrupted passage for flow of gas through the incoming gas-liquid mixture and also an annular passage for gas flow up through the incoming gas-liquid mixture. Further objects and advantages of the present invention will become apparent from the following detailed description, read in view of the accompanying drawings which are incorporated herein as part of this specification.

DETAILED DESCRIPTION OF THE PREFERRED EMBODIMENT OF THE INVENTION

Figure 1:
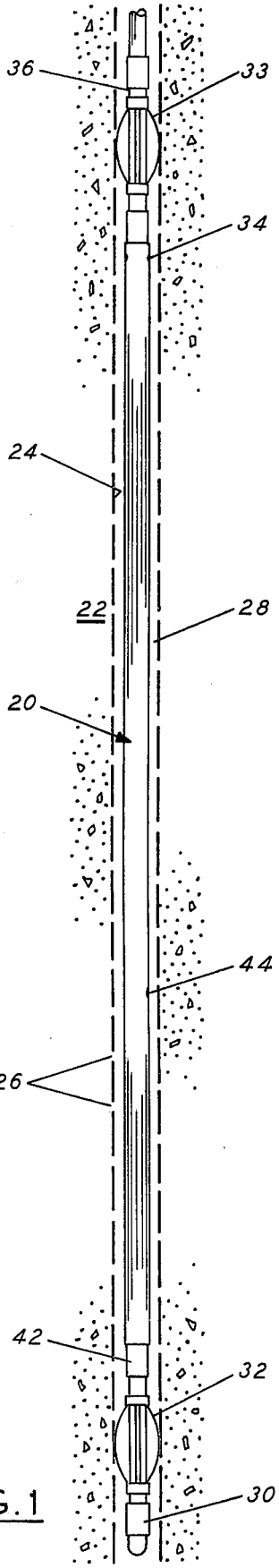
FIG. 1 is an elevation view partially in section, and illustrates apparatus assembled in accordance with the present invention positioned in a well.

IN FIG. 1, a bottom-hole gas-liquid separator is generally indicated by the number 20. The separator 20 is positioned in a well in position suitable to receive well fluids from a producing formation 22. Casing 24 is located in the well adjacent the producing formation. Formation fluids, including gas, oil and usually some water, are produced from the formation 22 through perforations 26 in the casing 24. The production fluids enter the well annulus 28 between the outside of the gas-liquid separator 20 and the inside of the casing 24.

The separator 22 is provided with removable plug means 30 for closing off its lower end. Centralizers 32, 33 may be used to centralize the separator in the well to prevent blockage of the inlet and gas outlet if the separator was to lie against one side of the casing. An inlet for fluids is formed in the wall of the separator 20 intermediate the ends thereof and substantially below the outlet 34 for gas. The inlet 44 permits the flow of production fluids into the interior of the separator 20. After separation, gas is returned into the casing-tubing annulus 28 preferably above the liquid level for transmission to the surface. Coupling means, such as tubing coupler 36, are provided on the upper end of the separator 20 for connecting it to a production string for producing liquid from the well.

Figure 2:
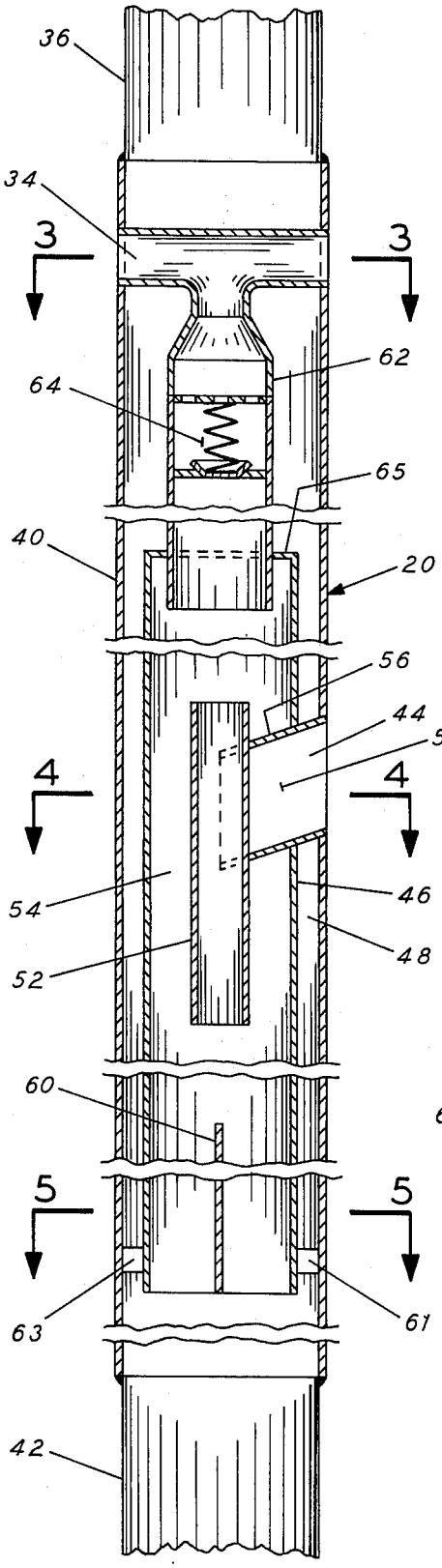
FIG. 2 is an elevation view partially in section and with portions broken away for clarity of presentation and shows the preferred embodiment of the apparatus assembled in accordance with the present invention.
Figure 3:
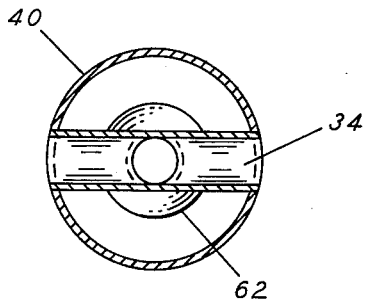
FIG. 3 is a sectional view taken at Section 3—3 of FIG. 2.
Figure 4:
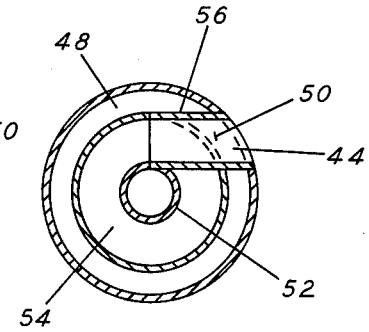
FIG. 4 is a sectional view taken at line 4—4 of FIG. 2.
Figure 5:
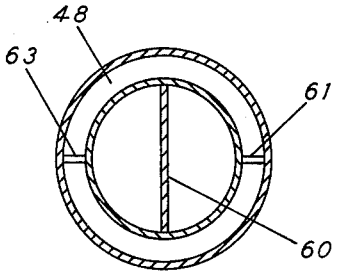
FIG. 5 is a sectional view taken at line 5—5 of FIG. 2.

FIG. 2 is an elevation view partially in section and with portions broken away for clarity of presentation and illustrates apparatus assembled in accordance with the preferred embodiment of the invention. FIGS. 3, 4 and 5 are sectional views taken as indicated from FIG. 2. As there shown, the bottom-hole gas-liquid separator generally indicated as 20 includes an outer tubular member 40. The outer tubular member 40 is an elongated member having an outer diameter suitable for running in a well to a position for producing fluids therefrom. Plug means are used to close off the lower end of tubular member 40 and are connected by means of tubing coupling 42 and a centralizer sub to the lower end of the elongated outer tubular member. Coupling means 36 are also provided on the upper end of the outer tubular member 40 for connecting the outer tubular member 40 to a production string for producing luquid from the well. An outer inlet 44 for fluid through the outer tubular member 40 is formed in the wall of the outer tubular member 40 intermediate the ends thereof and substantially below an outlet 34 for gas. An intermediate tubular member 46 is connected interiorly of the outer tubulr member 40. The intermediae tubular member 46 is smaller in diameter than the outer tubular member 40 and is positioned in concentric relationship therewith to form an outer annular chamber 48 with the outer tubular member 40. The intermediate tubular member 46 extends at least three times its outer diameter above the outer inlet 44 for fluid and six times its outer diameter below the outer inlet 44 for fluid. Centralizer lugs 61, 63 stabilize the lower end of the intermediate tubular member 46 inside of the outer tubular member 40. An inner inlet 50 for fluid is formed in the wall of the intermediate tubular member 46 just below the outer inlet 44. The inner inlet 50 and the outer inlet 44 are aligned to direct fluid into the interior of intermediate tubular member 46 in a downward direction. An inner tubular member 52 is arranged concentrically inside of the intermediate tubular member 46 and forms an inner annular chamber 54 therewith adjacent. The inner tubular member 52 is located adjacent the outer inlet 44 and the inner inlet 50 and extends from just above the inner inlet 50 to no more than 20 diameters below the inner inlet 50. Conduit means 56 connect the outer inlet 44 and the inner inlet 50 and provide the only flow path for fluids from the outer inlet through the outer annular chamber into the inside of the intermediate tubular member 46 through the inner inlet 50. The conduit means 56 are arranged to direct the flow of well fluids downwardly and tangentially into the inner annular chamber 54. A baffle plate 60 is connected in the lower end of the interior of the intermediate tubular member 46 fcr stopping the vortex flow of fluids and thus to prevent gas from being drawn down with the liquid. Gas conduit means 62 are connected to the upper end of the intermediate tubular member 46 fcr flowing gas to the gas outlet 34 in the upper end of the outer tubular member 40. An annular shoulder plate 65 provides a fluid-tight connection between the intermediate tubular member 46 and the gas conduit means. The gas conduit means are spaced above and apart from the inner tubular member 52 to provide a passageway for gas which immediately breaks out of the mixture in the inner annular chamber 54 and goes up the chamber 54 rather than down. An upwardly opening check valve 64 is provided in the gas conduit 62 to prevent entry of well fluids through the gas outlet 34 into the interior of the separator 20.

In operation, the separator is positioned in a well in a location adapted to receive well fluids. The well fluids enter the separator through conduit means 56, which imparts a downwardly spinning motion to the fluids as it enters the inner annular chamber 54. Centrifugal force causes the heavier liquid to move to the outside of the inner annular chamber 54 while the lighter gas moves toward the center of this chamber. As fluids move down the inner portion of inner tubular member 46 the gas comes to the central portion of this tubular member from where they are passed up the interior of inner tubular member 52 out of touch with the entering well fluids. There is a substantial distance between the upper end of the inner tubular member 52 and the beginning of gas conduit 62 so that any residual liquid droplets may fall out and a more dry gas proceeds up the gas conduit.

This spacing-apart of inner tubular member 52 and the beginning of gas conduit 62 also permits gas which immediately breaks out of the fluid mixture as it enters the inner annular chamber 54 to travel up the annular chamber directly to the gas conduit. In most instances, the opposing ends of the inner tubular member 52 and the gas conduit 64 should be spaced apart a distance equal to at least four times the diameter of the inner tubular member. As the remaining gas-liquid mixture moves down the separator to the bottom of the intermediate tubular member, the vortex motion is stopped by baffle 60 to prevent gas from being drawn down with the liquid. As the separation occurs, of course, the gas continues to move up and the liquid falls to the bottom of the outer tubular member 40. As the tubular member fills, the liquid goes up the outer annular chamber 48 through coupling 36 into the suction of a downhole pump (not shown) for removal to the surface. The gas, of course, moves through gas conduit 62, check valve 64, out into the tubing-casing annulus through gas outlet 34 for movement to the surface.

Although certain specific embodiments of the invention have been described in detail, the invention is not to be limited to only such embodiments, but rather by the scope of the appended claims.

What is claimed is:

1. A bottom-hole gas-liquid separator comprising:

an elongated outer tubular member having an outer diameter suitable for running in a well to a position for producing fluids therefrom, plug means closing off the lower end of said outer tubular member;

an outlet for gas formed in the wall of said outer tubular member near the upper portion thereof;

coupling means on the upper end of said outer tubular member for connecting said outer tubular member to a production string for producing liquid from a well;

an outer inlet for fluid in the wall of said outer tubular member intermediate the ends thereof and substantially below said outlet for gas;

an intermediate tubular member smaller than said outer tubular member connected interiorly of said outer tubular member in concentric relationship therewith and extending at least three times it outer diameter above said inlet and six times its outer diameter below said inlet and forming an outer annular chamber with said outer tubular member;

an inner inlet for fluid in the wall of said intermediate tubular member below said outer inlet;

an inner tubular member arranged concentrically inside of said intermediate tubular member and forming an inner annular chamber therewith adjacent said outer inlet and said inner inlet, said inner tubular member extending from just above said inner inlet to no more than 20 diameters below said inner inlet;

conduit means connecting said outer inlet and said inner inlet and providing the only flow path for fluids from said outer inlet through said outer annular chamber into said intermediate tubular member through said inner inlet, said conduit means arranged to divert flow of fluids downwardly and tangentially into said inner annular chamber; p1 a baffle plate connected in the lower end of said intermediate tubular member for stopping the vortex flow of fluids to prevent gas from being drawn down with the liquid and gas conduit means spaced above and apart from the inner tubular member connecting the upper end of said intermediate tubular member to said cutlet for gas.

2. The gas-liquid separator of claim 1 further characterized by an upwardly opening check valve in said gas conduit means.

3. The gas-liquid separator of claim 1 further characterized in that the opposing ends of the gas conduit and the inner tubular member are spaced apart at least a distance equal to four diameters of the inner tubular member.

* * * * *